United States Patent [19]

Luceno

[11] Patent Number: 5,018,365

[45] Date of Patent: May 28, 1991

[54] EARRING DEVICE

[76] Inventor: Elizabeth Luceno, 1646 Corkstone Glade, Mississauga, Ontario, L4W 2A1, Canada

[21] Appl. No.: 429,295

[22] Filed: Oct. 30, 1989

[30] Foreign Application Priority Data

Nov. 14, 1988 [CA] Canada ..... 583043

[51] Int. Cl.[5] ..... A44C 7/00

[52] U.S. Cl. ..... 63/12; 63/29.1; 24/705

[58] Field of Search ..... 63/2, 12, 13, 29.1; 24/705

[56] References Cited

U.S. PATENT DOCUMENTS

| | | | |
|---|---|---|---|
| 113,031 | 3/1871 | Edge | 63/12 |
| 2,713,863 | 7/1955 | Handerson | 62/12 X |

*Primary Examiner*—Kenneth J. Dorner
*Assistant Examiner*—J. Bonifanti
*Attorney, Agent, or Firm*—Arne I. Fors

[57] ABSTRACT

An earring securing device having an outer cylindrical flanged rear sleeve and an inner cylindrical flanged sleeve adapted to pass through an opening in an earlobe for threading into the outer rear sleeve whereby the outer sleeve flange and inner sleeve flange abut the rear and front of the ear respectively, and means positioned within the outer sleeve to removably secure the pin or stem of an earring against said front flange. The outer and inner sleeves and flanges are made of a precious or noble metal or metal alloy thereof.

5 Claims, 1 Drawing Sheet

FIG. 2
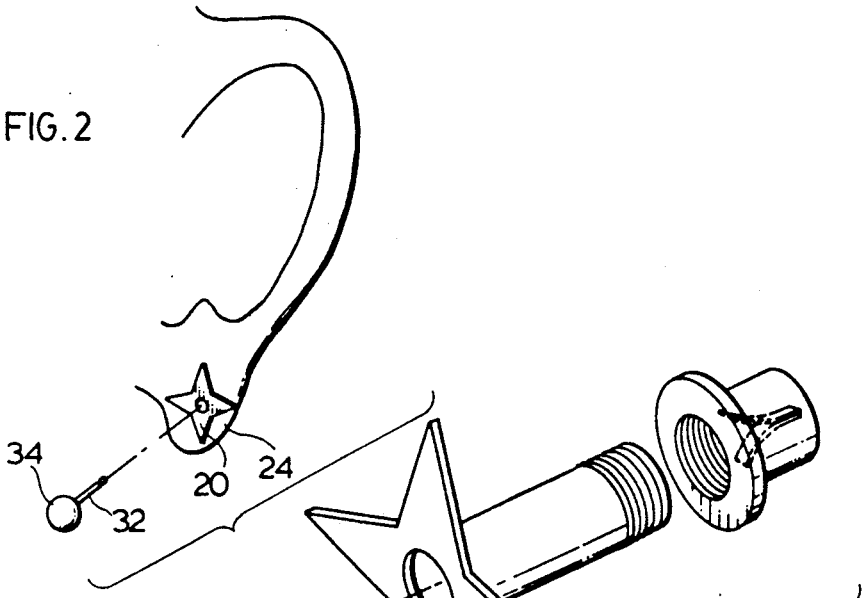
FIG. 3
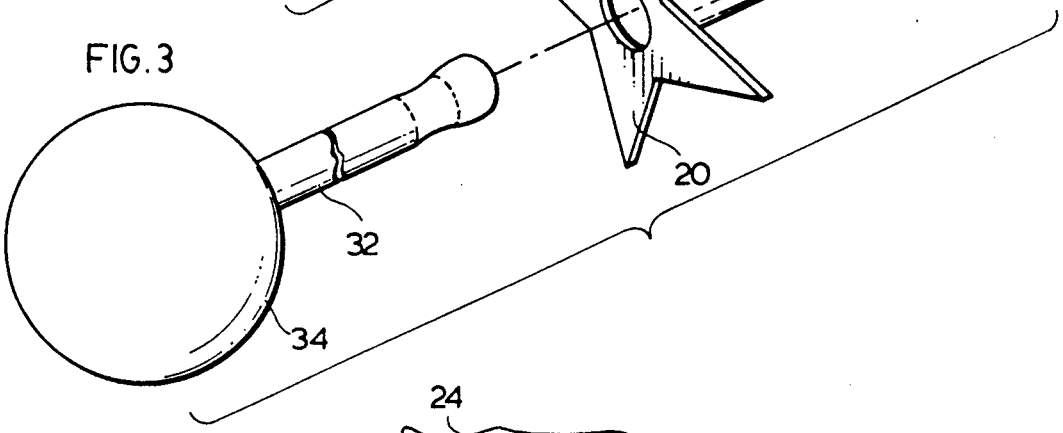
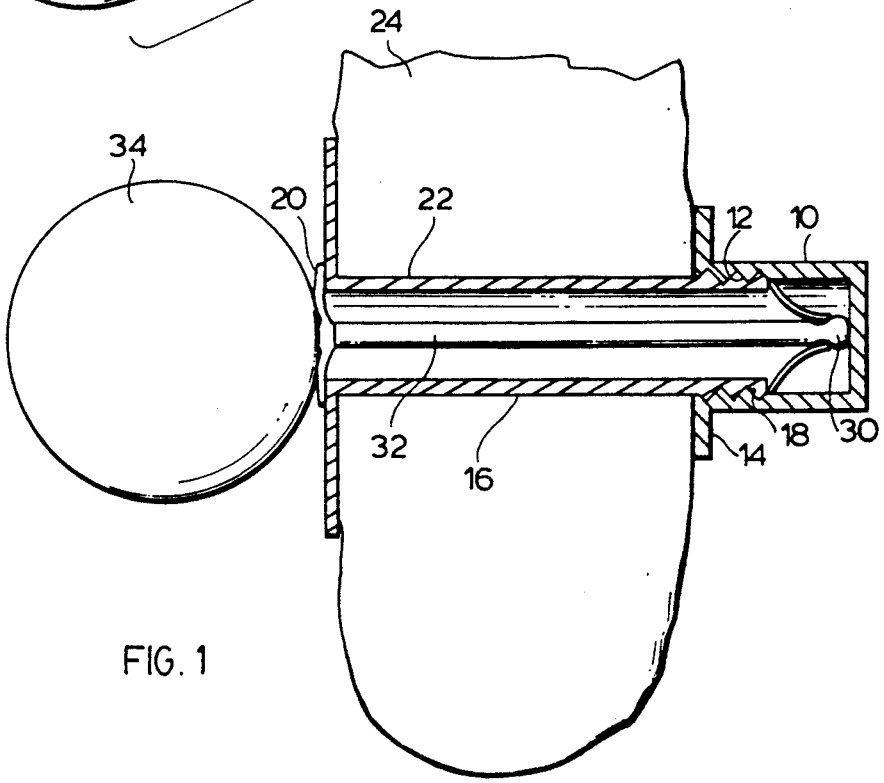
FIG. 1

EARRING DEVICE

BACKGROUND OF THE INVENTION

This invention relates to earrings and, more particularly, relates to a securing device for use with conventional earrings which avoids certain disadvantages of conventional earrings.

Most models and shapes of earrings are only available in low quality base metals in that earrings made of higher quality metals, such as gold and silver, are prohibitively expensive.

One such disadvantage is that infection of the earlobe often results from prolonged contact of the tissue or skin in and around the earlobe with low quality metals found in most conventional earrings. The use of a high quality metal such as gold will greatly reduce the risk of infection.

Another cause of infection is the recurring threading in an out of the earlobe of conventional earrings in order to change the decorative portion being worn.

Such infections are painful and unsightly. They can even force a person to stop wearring earrings through the earlobe. Scars can also result if the infection becomes severe.

It is a principal object of the invention to provide a relatively low cost device which ensures that only high quality precious metals such as gold come in contact with the skin in and around the earlobe, irrespective of the quality of the decorative portion of the earring being worn.

It is another important object of the invention to provide a device which does away with the necessity of threading the earring through the earlobe every time one wants to change the decorative portion of the earring being worn.

STATEMENT OF INVENTION

The present invention relates to an earring securing device which is used in conjunction with the front or decorative portion of conventional earrings currently available on the market. The device can be left permanently in the ear and provides a receptacle for holding in place the front portion of an earring. The back portion or butterfly of a conventional earring is not used.

The said device comprises an outer cylindrical sleeve case which is held behind the earlobe, in alignment with the an opening in the ear, and an elongated inner sleeve which passes through the earlobe, from the front to the back of the lobe, and is threaded into the outer case.

The forward portion of the outer case has a wide lip or flange which rests against and abuts the back of the earlobe. The forward portion of the inner case has a similar lip or flange which will come to rest against and abut the front of the earlobe once the inner case is suitably threaded into the outer case. The outer case has a gripping means within it to grip the pin or stem of the decorative portion of a conventional earring.

The inner sleeve, and preferably also the outer sleeve, are formed of a precious or noble metal or metal alloy.

In its broad aspect, the earring securing device of my invention for securement of an earring having a depending stem to an opening in an earlobe for abutment against the front and rear of the earlobe comprises an outer cylindrical sleeve having a threaded axial opening and a flange for abutment against the rear of the earlobe in alignment with the earlobe opening, an inner elongated cylindrical sleeve having a front flange and a threaded rear end adapted to be inserted through the earlobe opening to thread into the outer cylindrical sleeve whereby the flange abuts the front of the earlobe, and gripping means positioned within the outer sleeve for detachably gripping the earring stem therein whereby the earring is secured against the front flange of the inner sleeve. The inner and outer sleeves and respective flanges are formed of a precious or noble metal or metal alloy such as selected from the group consisting of gold, silver and platinum.

BRIEF DESCRIPTION OF THE DRAWINGS

Further characteristics, details and advantages of the invention will become apparent from the following description of the drawings, in which:

FIG. 1 is a side elevation of the securing device of the invention, partially cut away; and FIG. 2 is an exploded perspective of the said securing device in its operative position.

DESCRIPTION OF THE PREFERRED EMBODIMENT

With reference to the drawings, outer cylindrical rear sleeve 10 has a threaded axial opening or interior 12 with a flange, such as a star-shaped or ring-shaped flange 14, formed at its forward end. An inner elongated cylindrical sleeve 16 has external threads 18 at its rear end and a decorative flange, such as a circular or star-shaped flange 20, at its forward end.

Inner sleeve 16 is adapted to thread into rear sleeve 10 after insertion of sleeve 16 through opening 22 in earlobe 24 such that flanges 14, 20 will abut the sides of earlobe 24 for removable securement of inner sleeve 16 therein.

A gripping device, such as a butterfly clip 30 well known in the art, is inserted into outer sleeve 10 for removably receiving the pin or stem 32 of earring 34, as shown most clearly in FIG. 1.

Inner sleeve 16, and preferably also outer sleeve 10, preferably are formed of precious or noble metals or metal alloys such as gold, silver, platinum or alloys thereof which do not readily oxidize or corrode and which are reasonably compatible with human skin and tissue. Earrings 34 and depending pins or stems 32 may be conventionally formed of less expensive base metals or alloys since they do not come into physical contact with the skin or tissue of the earlobe, thus avoiding or minimizing undesirable infections and resulting scar and the like earlobe damage.

Rear outer sleeve 10 is axially mounted by the mating threads on inner sleeve 16, to adjust for the thickness of the user's earlobe and to compensate for the user's comfort.

It will be understood of course that modifications can be made in the embodiment of the invention illustrated and described herein without departing from the scope and purview of the invention as defined by the appended claims.

The embodiments of the invention in which an exclusive property or privilege is claimed are defined as follows:

1. A device for securement of an earring having a depending stem to an opening in an earlobe for abutment against the front and rear of the earlobe comprising an outer cylindrical sleeve having a threaded axial opening and a flange for abutment against the rear of the earlobe in alignment with the earlobe opening, an inner elongated cylindrical sleeve having a front flange and a threaded rear end adapted to be inserted through the earlobe opening to thread into the outer cylindrical sleeve whereby the front flange abuts the front of the earlobe, and gripping means positioned within the outer sleeve for detachably gripping the earring stem therein whereby the earring is secured against the front flange of the inner sleeve.

2. A device as claimed in claim 1 in which said inner and outer sleeves and respective flanges are formed of a precious or noble metal or metal alloy.

3. A device as claimed in claim 2 in which said noble or precious metal is selected from the group consisting of gold, silver and platinum

4. A device as claimed in claim 2 in which said flange abutting the front of the ear is decorative.

5. An earring securing device for insertion into an opening in an earlobe comprising an inner hollow cylindrical sleeve formed of a precious or noble metal or metal alloy having a flange at one end and external threads at the other end adapted to be inserted into said earlobe opening whereby the flange abuts the front of the earlobe and the external threads project from the earlobe on the opposite side thereof, an outer cylindrical sleeve having a flange at one end and internal threads at the other end adapted to mate with and thread into the threaded end of the inner sleeve whereby the outer sleeve flange abuts the said opposite side of the earlobe to secure the inner sleeve to the earlobe, and gripping means formed within the outer sleeve for receiving and removably securing a stem projecting from a conventional earring for mounting said earring on the earlobe whereby the earring does not touch the earlobe.

* * * * *